US007284575B2

(12) United States Patent
Gram et al.

(10) Patent No.: US 7,284,575 B2
(45) Date of Patent: Oct. 23, 2007

(54) COMBINED LIQUEFIED GAS AND COMPRESSED GAS RE-FUELING STATION AND METHOD OF OPERATING SAME

(75) Inventors: Anker Gram, Vancouver (CA); Mihai Ursan, Burnaby (CA)

(73) Assignee: Westport Power Inc. (CA)

( * ) Notice: Subject to any disclaimer, the term of this patent is extended or adjusted under 35 U.S.C. 154(b) by 142 days.

(21) Appl. No.: 10/527,122

(22) PCT Filed: Sep. 3, 2003

(86) PCT No.: PCT/CA03/01345

§ 371 (c)(1),
(2), (4) Date: Aug. 3, 2005

(87) PCT Pub. No.: WO2004/023029

PCT Pub. Date: Mar. 18, 2004

(65) Prior Publication Data

US 2006/0005895 A1 Jan. 12, 2006

(30) Foreign Application Priority Data

Sep. 6, 2002 (CA) ..... 2401926

(51) Int. Cl.
*B65B 1/04* (2006.01)

(52) U.S. Cl. ..... 141/82; 141/9; 141/100

(58) Field of Classification Search ..... 141/9, 141/100, 104, 82; 222/146.6, 146.1; 62/50.2, 62/50.6; 417/901
See application file for complete search history.

(56) References Cited

U.S. PATENT DOCUMENTS 3,812,888 A 5/1974 Dalton
4,136,721 A 1/1979 Holmqvist et al.
4,211,085 A 7/1980 Tyree, Jr.
4,406,129 A 9/1983 Mills
4,494,415 A 1/1985 Elliston
4,662,181 A 5/1987 Brigham
4,716,738 A 1/1988 Tatge et al.
4,738,115 A 4/1988 Goode
5,107,906 A 4/1992 Swenson et al.

(Continued)

FOREIGN PATENT DOCUMENTS

DE 10107187 A1 8/2002

(Continued)

*Primary Examiner*—Steven O. Douglas
(74) *Attorney, Agent, or Firm*—McAndrews, Held & Malloy, Ltd.

(57) ABSTRACT

A re-fueling station is provided for selectively dispensing fuel in the form of liquefied gas or compressed gas. The re-fueling station comprises a storage tank for storing liquefied gas; a positive displacement fuel pump operable to draw fuel from the storage tank and discharge fuel to a flow diverter, which is operable to selectively direct fuel through one of a first outlet or a second outlet; and conduits through which fuel may flow from the first outlet to a heat exchanger and then to a first dispenser for dispensing compressed gas, or from the second outlet to a second dispenser for dispensing liquefied gas. A method is provided comprising operating the fuel pump in a low speed mode when fuel is directed to the first dispenser and operating the fuel pump in a high speed mode when fuel is directed to the second dispenser.

33 Claims, 5 Drawing Sheets

U.S. PATENT DOCUMENTS

| | | | | |
|---|---|---|---|---|
| 5,121,609 | A | 6/1992 | Cieslukowski | |
| 5,228,295 | A | 7/1993 | Gustafson | |
| 5,315,831 | A | 5/1994 | Goode et al. | |
| 5,360,139 | A | 11/1994 | Goode | |
| 5,373,702 | A | 12/1994 | Kalet et al. | |
| 5,409,046 | A | 4/1995 | Swenson et al. | |
| 5,411,374 | A | 5/1995 | Gram | |
| 5,421,160 | A | 6/1995 | Gustafson et al. | |
| 5,465,583 | A | 11/1995 | Goode | |
| 5,477,690 | A | 12/1995 | Gram | |
| 5,505,232 | A | 4/1996 | Barclay | |
| 5,537,824 | A | 7/1996 | Gustafson et al. | |
| 5,549,142 | A | 8/1996 | Beale | |
| 5,551,488 | A | 9/1996 | Gram | |
| 5,582,218 | A | 12/1996 | Beale | |
| 5,682,750 | A | 11/1997 | Preston et al. | |
| 5,765,602 | A | 6/1998 | Sutton et al. | |
| RE35,874 | E | 8/1998 | Neeser et al. | |
| 5,884,488 | A | 3/1999 | Gram et al. | |
| 6,044,647 | A | 4/2000 | Drube et al. | |
| 6,142,191 | A | 11/2000 | Sutton et al. | |
| 6,659,730 | B2 | 12/2003 | Gram et al. | |
| 7,069,730 | B2 * | 7/2006 | Emmer et al. | 62/50.1 |
| 2002/0085921 | A1 | 7/2002 | Gram et al. | |

FOREIGN PATENT DOCUMENTS

| | | |
|---|---|---|
| EP | 1247980 | 10/2002 |
| JP | 2003148695 | 5/2003 |

* cited by examiner

COMBINED LIQUEFIED GAS AND COMPRESSED GAS RE-FUELING STATION AND METHOD OF OPERATING SAME

FIELD OF THE INVENTION

This invention relates to a re-fueling station for vehicles. More particularly, the invention relates to a re-fueling station that can supply either liquefied gas or compressed gas, as required by the vehicle, and a method of operating such a station. While not wishing to be limited to any particular fuel gas, natural gas shall be used as a convenient example, and references to the fuel hereafter will be to liquefied natural gas (LNG) and compressed natural gas (CNG). Those skilled in the art will understand that a different liquefied fuel gas such as hydrogen may be substituted for natural gas without deviating from the spirit of the disclosed invention.

BACKGROUND OF THE INVENTION

Natural gas has been used as a fuel for piston engine driven vehicles for over fifty years. The desire to improve efficiency and reduce pollution is causing continual change and improvements in the available technology. Some companies are also researching the use of other gaseous fuels, such as hydrogen, as a substitute for liquid fuels.

Some vehicles are designed with fuel systems that store compressed gas in pressure vessels. For example, CNG is commonly stored at ambient temperatures at pressures up to 3600 pounds per square inch (24,925 kPa). CNG can be stored at higher pressures, but this adds to the weight of the storage tanks because they need to be designed and certified for such higher pressures.

Because the energy density of liquefied gas is much greater than that of compressed gas, vehicles designed for longer range sometimes employ fuel systems that store liquefied gas at cryogenic temperatures in special thermally insulated tanks. For example, LNG is normally stored at temperatures of between about −240° F. and −175° F. (about −150° C. and −115° C.), hereinafter generally referred to as "cryogenic temperatures", and at pressures of between about 15 and 200 psig (204 and 1477 kPa). LNG storage tanks mounted on vehicles can store fuel for several days under common operating conditions. For vehicles in regular use, storing fuel at cryogenic temperatures is not a problem.

Despite the longtime use of natural gas fueled vehicles, these vehicles represent only a small fraction of the total number of vehicles currently in use and compared to the vast number of gasoline and diesel re-fueling stations, there remains a relatively small number of liquefied gas re-fueling stations. Conventional natural gas re-fueling stations are typically designed for supplying only one of LNG or CNG. When a re-fueling station is intended to serve a fleet of vehicles, the fleet can be standardized to use only LNG or only CNG. However, for re-fueling stations that are intended to serve the general public, or a plurality of commercial fleets, there is a need for a re-fueling station that can supply either LNG or CNG.

Since LNG is stored at low pressures compared to CNG, LNG re-fueling stations deliver fuel at relatively low pressures. For cryogenic fluids, centrifugal pumps are suitable for operating within the typical pressure ranges and are capable of operating with high flow rates. Centrifugal pumps designed for cryogenic fluids offer reasonable efficiency in addition to being relatively inexpensive.

Centrifugal pumps typically require fuel to be supplied to the pump suction with a positive value for the net suction head (NSH), which is defined as the difference between the pump inlet pressure and the inlet saturation pressure (expressed in terms of head). NSH is positive as long as the pump inlet pressure is greater than the inlet saturation pressure. Conversely, NSH can be negative when pump inlet pressure is less than the inlet saturation pressure.

Other LNG re-fueling stations use a pressure transfer system where vapor pressure within the LNG storage tank is controlled to provide the means for displacing the LNG from the storage tank. However, such pressure transfer systems result in extra heat being introduced into the storage tank, and may require additional equipment to prevent over-pressurization of the LNG storage tank. For example, some pressure transfer systems further comprise equipment for refrigerating and/or re-condensing vapor, and/or rely on higher quantities of gas being removed through pressure relief systems.

Another disadvantage with a pressure transfer system is that fuel delivery can be delayed since it takes time to build pressure within the storage tank.

On the other hand, CNG re-fueling stations typically employ positive displacement compressors and a cascading CNG storage system for delivering relatively high-pressure gas. Even though conventional CNG compressors operate at relatively high speeds, flow rates are typically relatively low. A cascading CNG storage system is typically used to ensure an adequate supply of high-pressure gas to fill an average-sized vehicle fuel tank in an acceptable amount of time.

The divergent operating conditions between re-fueling stations for LNG (low pressure with high mass flow rate) and CNG (high pressure with low mass flow rate) have presented a challenge for designing a simple re-fueling station capable of delivering both LNG and CNG, especially when it is desirable to have a system with only one fuel pump or compressor for quickly dispensing either LNG or CNG.

U.S. Pat. No. 5,315,831 issued 21 May 1994 (the '831 patent) discloses a combined LNG and CNG fueling station. Vapor pressure in the cryogenic tank is employed to deliver LNG to the dispenser and a natural gas fueled internal combustion engine is employed to drive a fuel pump while providing heat to a heat exchanger for producing CNG. In some embodiments, pressure within the cryogenic storage tank is relieved by bleeding gas from the storage tank into the fuel supply system for the internal combustion engine.

Accordingly, the '831 patent discloses a pressure transfer system for delivering LNG from the re-fueling station. However, as already noted, there are disadvantages associated with a pressure transfer system, such as more frequent venting from the LNG storage tank when pressure within the storage tank exceeds a predetermined maximum pressure. Venting from the LNG storage tank results in wasted natural gas.

In other arrangements, to avoid frequent venting, refrigeration equipment may be employed for re-condensing the natural gas or at least cooling the gas to collapse some of the pressure within the LNG storage tank. However, such arrangements add to the complexity of the system in addition to increased capital and operational costs.

SUMMARY OF THE INVENTION

A combined liquefied gas and compressed gas re-fueling station is provided for selectively dispensing fuel in the form of liquefied gas or compressed gas, and provides cost-effectiveness and versatility compared to conventional refueling stations. The combined liquefied gas and compressed gas re-fueling station comprises:

(a) a storage tank within which liquefied gas may be stored;

(b) a dispensing system comprising:

a first dispenser for dispensing compressed gas;

a second dispenser for dispensing liquefied gas;

a heat exchanger operable to transfer heat to the fuel;

a flow diverter operable to receive fuel through an inlet and selectively direct fuel through one of a first outlet or a second outlet;

conduits through which fuel may flow from the first outlet to the heat exchanger and then to the first dispenser, or from the second outlet to the second dispenser; and (c) a positive displacement fuel pump operable to draw fuel from the storage tank and discharge fuel to the inlet of the flow diverter.

The positive displacement fuel pump is preferably a reciprocating piston fuel pump that can pump liquefied gas, vapor, or a mixture of liquefied gas and vapor. An example of a preferred embodiment of a reciprocating piston fuel pump is described in the Applicant's U.S. Pat. No. 5,884,488. This type of fuel pump is operable with a negative net suction head and this allows greater flexibility in locating the fuel pump in relation to the storage tank, and this facilitates re-fueling station arrangements where the storage tank is buried underground. The fuel pump is preferably a double-acting fuel pump.

In a preferred arrangement, the reciprocating piston fuel pump is selectively operable in a low speed mode when fuel flow is directed to the first dispenser to deliver compressed gas; and, in a high speed mode when fuel flow is directed to the second dispenser to deliver liquefied gas, whereby the fuel pump operates with a higher number of cycles per minute compared to when the fuel pump is operated in the low speed mode. The fuel pump is driven by at least one hydraulic cylinder.

For example, in a preferred embodiment, one of two separate hydraulic cylinders, each with a different diameter is selected to drive the pump. With this embodiment, the high speed and low speed operating modes can be efficiently met with a single hydraulic pump. For example, the smaller hydraulic cylinder, which has a smaller displaced volume, can be used for operating the fuel pump at faster speeds for delivering liquefied gas, which is delivered to a relatively low-pressure vessel, and the larger hydraulic cylinder, which has a larger displaced volume, can be used for operating the fuel pump at slower speeds for delivering compressed gas, which is delivered to a relatively high-pressure vessel. The larger hydraulic cylinder is idle when the smaller hydraulic cylinder is driving the fuel pump, and vice versa. Because the power requirements for the fuel pump correlate to the product of fluid pressure and fluid mass flow rate, a single hydraulic pump can be used to satisfy both operating modes, namely the low speed mode for delivering compressed gas at high pressure and a low mass flow rate, and the high speed mode for delivering compressed gas at low pressure and a high mass flow rate.

Advantageously, fuel pump speed may be changed to selectively operate in a high-speed mode or a low speed mode, using one hydraulic pump that supplies hydraulic fluid to one of the two hydraulic cylinders, while the other hydraulic cylinder is idle.

For additional versatility, the hydraulic pump may be a variable speed hydraulic pump. By controlling the speed of the hydraulic pump further modulation of fuel pump speed is possible. An example where this might be advantageous is a re-fueling station that has a plurality of liquefied gas or compressed gas dispensers that may or may not be all activated at the same time.

The reciprocating piston fuel pump preferably comprises:

a first compression chamber associated with a fuel pump inlet;

a one-way inlet valve positioned in the fuel pump inlet for allowing fluid flow into the first compression chamber;

a second compression chamber associated with a fuel pump discharge port; a reciprocable piston assembly comprising a shaft connected to a drive mechanism and a piston head that separates the first compression chamber from the second compression chamber; and a one-way transfer valve positioned in fluid passages communicating between the first and second compression chambers, the one-way transfer valve allowing fluid flow from the first compression chamber into the second compression chamber.

The displaced volume of the first compression chamber is preferably larger than the displaced volume of the second compression chamber, and more preferably, the displaced volume of the first compression chamber is about two times the displaced volume of the second compression chamber.

The fuel pump piston assembly comprises the piston and the piston shaft. To reduce the piping between the first and second compression chambers, the one-way transfer valve and the fluid passage between the first and second compression chambers are preferably disposed within the piston assembly.

A vertical or inclined alignment of the piston shaft is preferred so that the suction inlet for the fuel pump may be disposed within a sump and fuel that leaks from the compression chambers can flow back into the sump under the influence of gravity. The vertically aligned or inclined fuel pump preferably further comprises a fluid recovery chamber above the first and second compression chambers for collecting fuel and returning it to a sump. The fuel may be returned to the sump from the recovery chamber through an open drain port located near the bottom of the recovery chamber.

The re-fueling station may further comprise an accumulator vessel disposed between the heat exchanger and the first dispenser. However, because the mass flow capacity of the disclosed fuel pump system can be designed to satisfy desired flow rates for re-fueling stations, a cascade system is not required, and even the accumulator vessel may be rendered optional.

A method is provided of operating a re-fueling station to selectively supply liquefied gas or compressed gas. The method comprises:

(a) drawing liquefied gas from a cryogenic storage tank to a reciprocating piston fuel pump;

(b) operating the fuel pump in a low speed mode when fuel is directed from the fuel pump to a heat exchanger for transferring heat to the liquefied gas and then a compressed gas dispenser; and (c) operating the fuel pump in a high speed mode when fuel is directed from the fuel pump to a liquefied gas dispenser, wherein in the high speed mode, the fuel pump operates with a higher number of cycles per minute than when the fuel pump is operating in the low speed mode.

In a preferred method the fuel pump is operable at speeds between 5 and 30 cycles per minute. In a particular embodiment, the fuel pump operates between about five and twelve cycles per minute when the low speed mode is selected and at between about ten and twenty cycles per minute when the high-speed mode is selected. In another embodiment the fuel pump operates at about six cycles per minute when the low speed mode is selected and at about eighteen cycles per minute when the high-speed mode is selected.

Another embodiment provides a method of operating a re-fueling station to selectively supply liquefied gas or compressed gas; this method comprising:

(a) drawing liquefied gas from a cryogenic storage tank to a reciprocating piston fuel pump;

(b) selectively driving the fuel pump with a first hydraulic cylinder when fuel is directed from the fuel pump to a heat exchanger for transferring heat to the liquefied gas, and then to a compressed gas dispenser;

(c) selectively driving the fuel pump with a second hydraulic cylinder when fuel is directed from the fuel pump to a liquefied gas dispenser, wherein the second hydraulic cylinder has a smaller displaced volume than that of the first hydraulic cylinder; and (d) supplying hydraulic fluid from a hydraulic pump system to the selected one of the first or second hydraulic cylinders.

In all methods, the hydraulic pump system preferably comprises a single hydraulic pump, for reduced capital costs and lower maintenance costs. However, a plurality of hydraulic pumps may also be employed without departing from the spirit of this invention. For example, a re-fueling station may employ a stand-by hydraulic pump, or a tandem arrangement, depending upon the needs of the re-fueling station.

BRIEF DESCRIPTION OF THE DRAWINGS

The drawings illustrate specific embodiments of the invention, but should not be construed as restricting the scope of the invention:

FIG. 5*a* shows the fuel pump with the fuel pump inlet end disposed within a sump. FIG. 5*b* shows how hydraulic fluid is directed to the smaller hydraulic cylinder when liquefied gas is dispensed, and FIG. 5*c* shows how hydraulic fluid is directed to the larger hydraulic cylinder when compressed gas is dispensed.

DETAILED DESCRIPTION OF PREFERRED EMBODIMENT(S)

Figure 1:
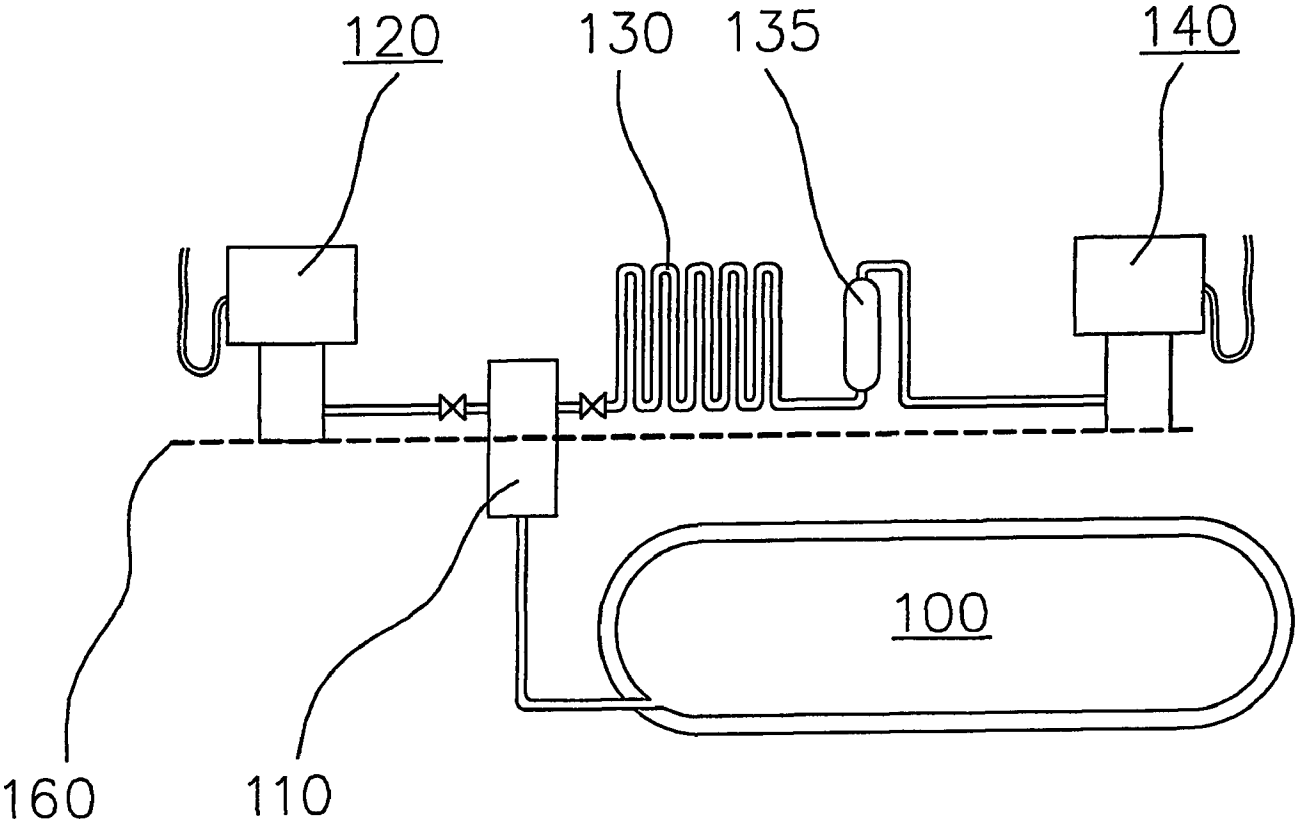
FIG. 1 is a schematic view of a combined liquefied gas and compressed gas re-fueling station that comprises a single fuel pump for supplying liquefied gas and compressed gas and separate dispensers for liquefied gas and compressed gas.

Referring to FIG. 1, a combined liquefied gas and compressed gas re-fueling station comprises LNG storage tank 100, fuel pump unit 110, LNG dispenser 120, heat exchanger 130 and CNG dispenser 140. Odorizer 135 is typically required to add an odor to CNG so as to comply with safety regulations. Dashed line 160 indicates ground level.

In a preferred embodiment, LNG storage tank 100 is buried underground. As noted above, since LNG is stored at cryogenic temperatures (typically less than −175° F. (−115° C.) for LNG), an advantage of burying LNG storage tank 100 compared to a tank situated above ground, is that there is much less temperature variation around underground LNG storage tank 100. Another advantage is that an underground storage tank conserves more space above ground for improved accessibility of vehicles to the dispensers. Building codes also typically require less distance between an underground storage tank and an adjacent property, compared to an above-ground storage tank. LNG storage tank 100 preferably has a double wall with a vacuum applied in the space between the walls to provide further thermal insulation.

Figure 4:
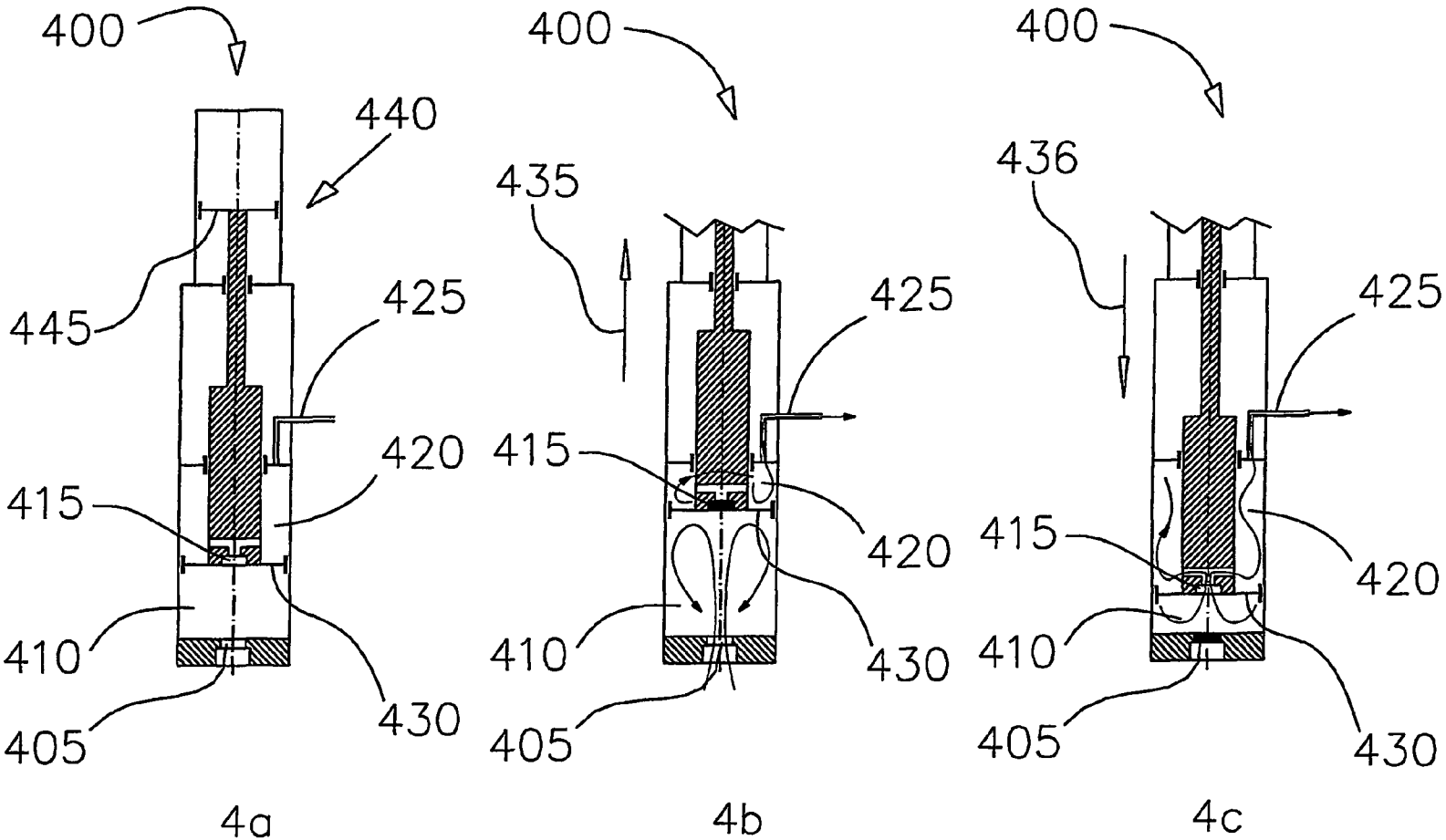
FIG. 4*a* illustrates a section view of a schematic arrangement for a hydraulically driven two chamber reciprocating piston fuel pump for delivering fuel to the dispensers.
FIG. 4*b* illustrates a retraction stroke of the fuel pump wherein fuel is drawn through the fuel pump inlet into a first chamber, and discharged from a second chamber.
FIG. 4*c* illustrates an extension stroke of the fuel pump wherein the fuel pump inlet is closed and fuel is transferred from the first chamber to the second chamber from which fuel is discharged.
Figure 5:
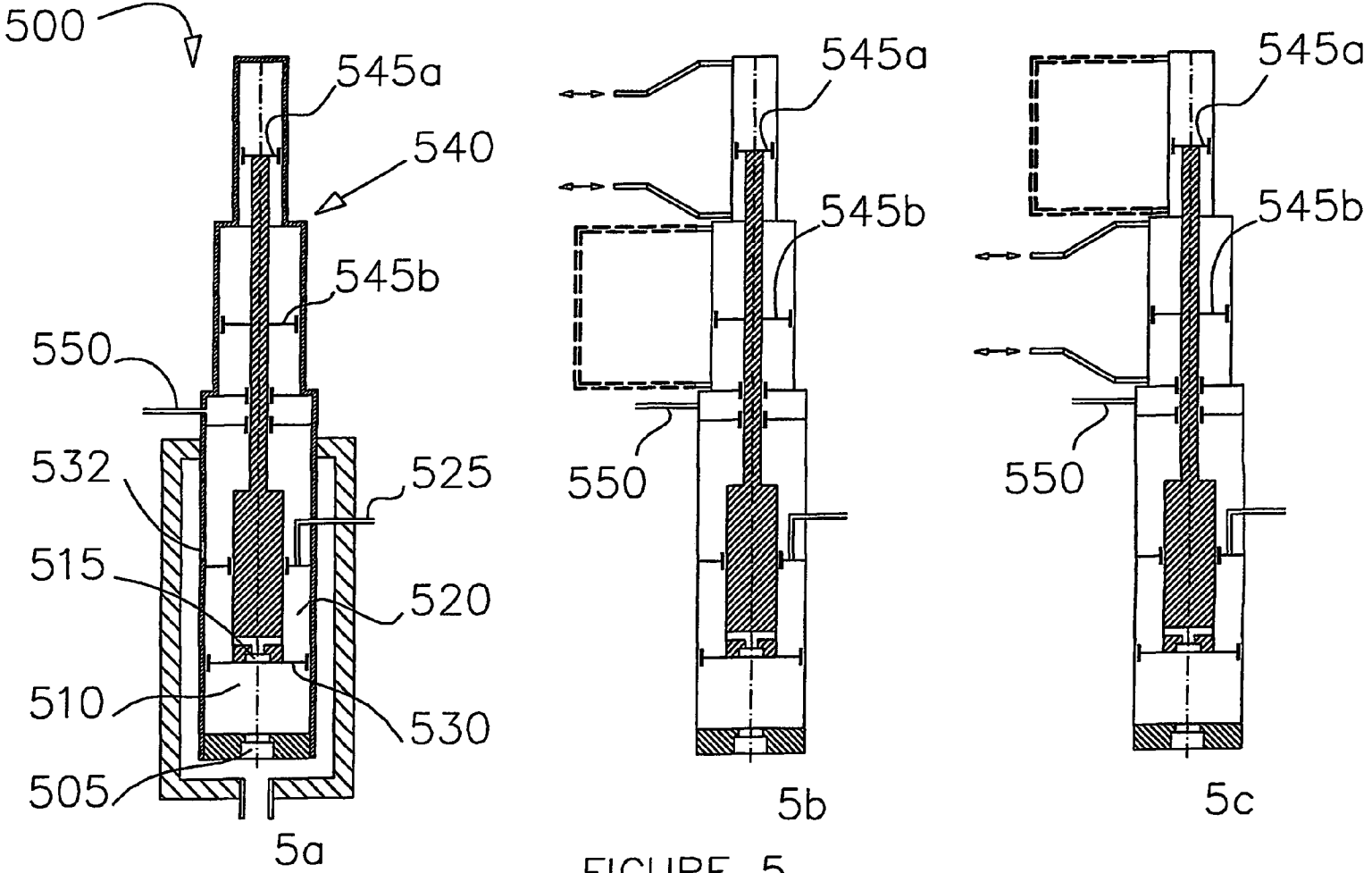
FIGS. 5*a* through 5*c* illustrate an embodiment of a fuel pump that employs a dual hydraulic drive.

Fuel pump unit 110 comprises a positive displacement fuel pump disposed within a sump. Preferred arrangements for a reciprocating piston fuel pump are shown in FIGS. 4 and 5. Compared to centrifugal pumps, which are more commonly employed for pumping LNG, a positive displacement fuel pump can pump both liquid and vapor, which enables fuel pump unit 110 to operate with a negative NSH, facilitating the positioning of LNG storage tank 100 underground.

Fuel pump unit 110 further comprises a flow diverter, which can be controlled to direct fuel to one of the LNG dispenser or the CNG dispenser. Preferably, the activation of the LNG dispenser and/or the CNG dispenser automatically controls the flow diverter so that fuel is directed from the fuel pump discharge to the activated dispenser.

If the fuel pump is activated and it requires cooling to lower its temperature to the desired operating temperature for supplying fuel, a cool down procedure is initiated. A cool down procedure is required, for example, whenever the fuel pump has not been used for a period of time and the passages and chambers through which the LNG flows have become warmer than cryogenic temperatures.

To cool down fuel pump unit 110, LNG is supplied from LNG storage tank 100. LNG vaporizes as it cools fuel pump unit 110 and the associated piping between LNG storage tank 100 and fuel pump unit 110. The vaporized LNG is returned to LNG storage tank 100. Preferably the vapor is returned to the top of the tank to temporarily raise vapor pressure within the LNG storage tank 100, helping to push more LNG from storage tank 100 to cool fuel pump unit 110. When vapor is no longer being introduced into LNG storage tank 100, a thermal equilibrium is eventually reached within the storage tank and vapor pressure declines when some of the vapor re-condenses after being cooled by exposure to the LNG in the bottom of the LNG storage tank 100.

When the LNG dispenser is activated, the demand placed upon fuel pump unit 110 is for a high mass flow rate at a relatively low pressure. To satisfy this demand, the fuel pump preferably operates in a high-speed mode.

In a preferred arrangement for the flow diverter, the discharge from the fuel pump is connected to a tee or a "Y" with a first branch of leading to LNG dispenser 120 and a second branch leading ultimately to CNG dispenser 140.

Associated with the first branch is a shut off valve that is preferably automatically opened when LNG dispenser 120 is activated. The shut off valve automatically closes when LNG dispenser 120 is shut down.

Associated with the second branch is a one-way valve that only allows fuel to flow from the flow diverter towards CNG dispenser 140. Downstream of the one-way valve is the high pressure CNG dispensing system and the one-way valve prevents high-pressure fuel from flowing back into fuel pump unit 110. The high pressure CNG downstream from the one-way valve also prevents fuel from flowing into the second branch when the shut off valve is open because the fuel will flow into the first branch where the fuel pressure is much lower.

If the CNG dispenser is activated, the shut off valve remains closed and fuel is forced through the one-way valve. Under these conditions, the demand placed upon the fuel pump is for a high discharge pressure and mass flow rate need not be as high compared to when LNG dispenser 120 is activated.

Without departing from the spirit of arrangement described above, the diverter may employ other valve arrangements. For example, a three-way valve could be substituted for the tee or "Y", the shut off valve, and the one-way valve. In one position, the three-way valve diverts fuel to LNG dispenser 120, and in a second position, the three-way valve diverts fuel to CNG dispenser 140. The three-way valve may be manually actuated or actuated by an actuator that is controlled by a remotely located switch or controller.

An advantage of the disclosed re-fueling station arrangement is that a positive displacement fuel pump can be sized to provide acceptable re-fueling rates for both LNG and CNG dispensers without the CNG dispensing system requiring a cascading arrangement or an accumulator vessel. As described in greater detail below, the positive displacement fuel pump is preferably a reciprocating piston fuel pump that can operate at lower speeds for delivering CNG at high pressure and low mass flow rates, and at high speeds for delivering LNG at relatively low pressures and relatively high mass flow rates. While an accumulator vessel can be added to the disclosed arrangement, it is not necessary for operation within commercially acceptable parameters because of the versatility of the fuel pump when operated in the disclosed manner. Operating without an accumulator vessel can help to reduce the costs of the overall system. For example, some of the features that enable the elimination of the accumulator include the fuel pump speed control using two hydraulic cylinders, which adds to the versatility of the flow rate through the fuel pump, and the double-acting fuel pump design, which allows continuous fuel discharge from the fuel pump.

Heat exchanger 130 and odorizer 135 are conventional components of known design.

Figure 2:
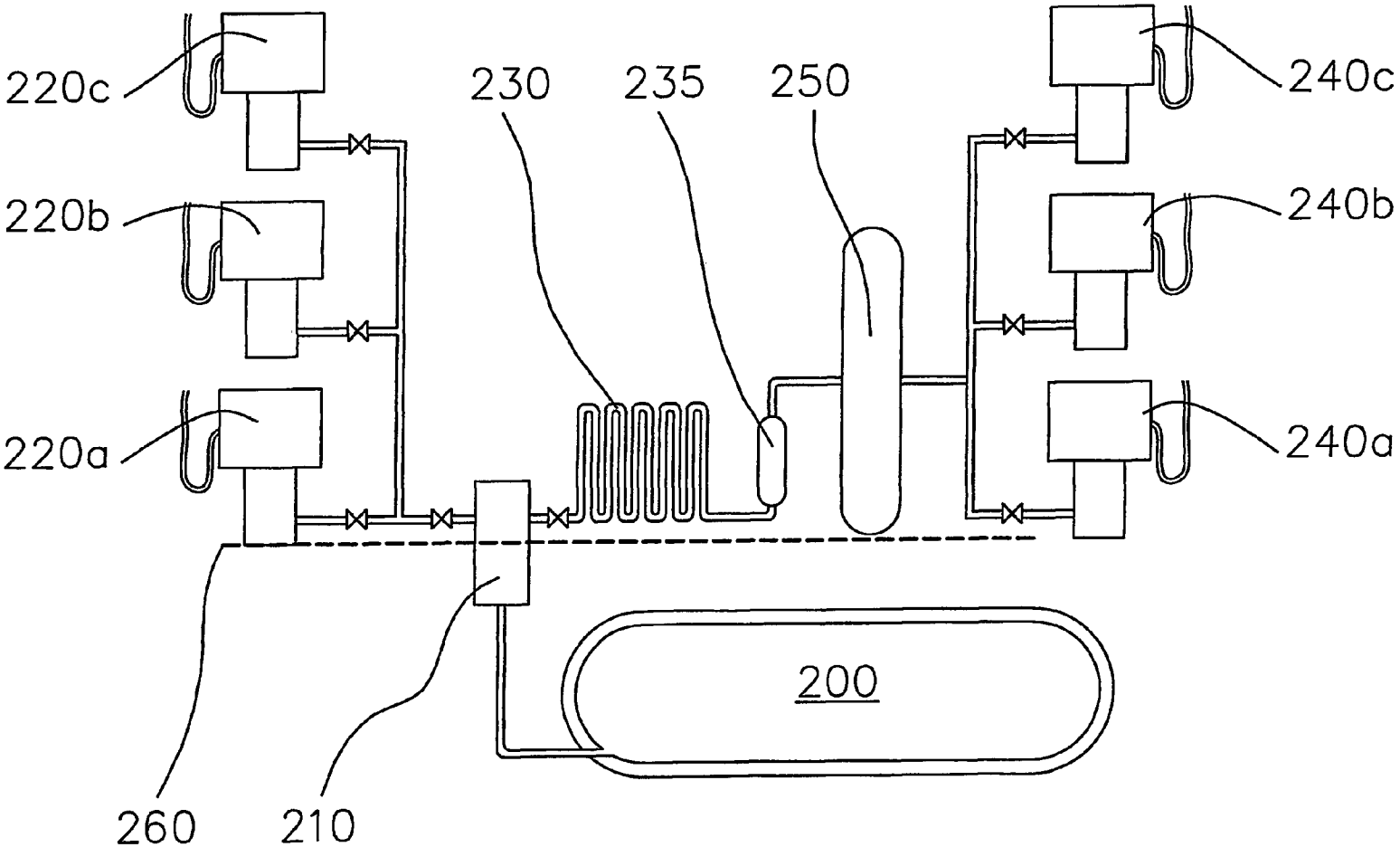
FIG. 2 is a schematic view of a combined liquefied gas and compressed gas re-fueling station that comprises a single fuel pump for supplying liquefied gas and compressed gas and a plurality of separate dispensers for liquefied gas and compressed gas.

With reference now to FIG. 2, a combined LNG and CNG re-fueling station comprises LNG storage tank 200, fuel pump unit 210, a plurality of LNG dispensers 220*a*, 220*b*, and 220*c*, heat exchanger 230, odorizer 235 and a plurality of CNG dispensers 240*a*, 240*b*, and 240*c*. Dashed line 260 indicates ground level. The arrangement shown in FIG. 2 includes accumulator vessel 250, although as mentioned above, by appropriately sizing the fuel pump and controlling fuel pump speed, the flow capacity of fuel pump unit 210 can be adjusted to obviate the need for accumulator vessel 250.

Figure 3:
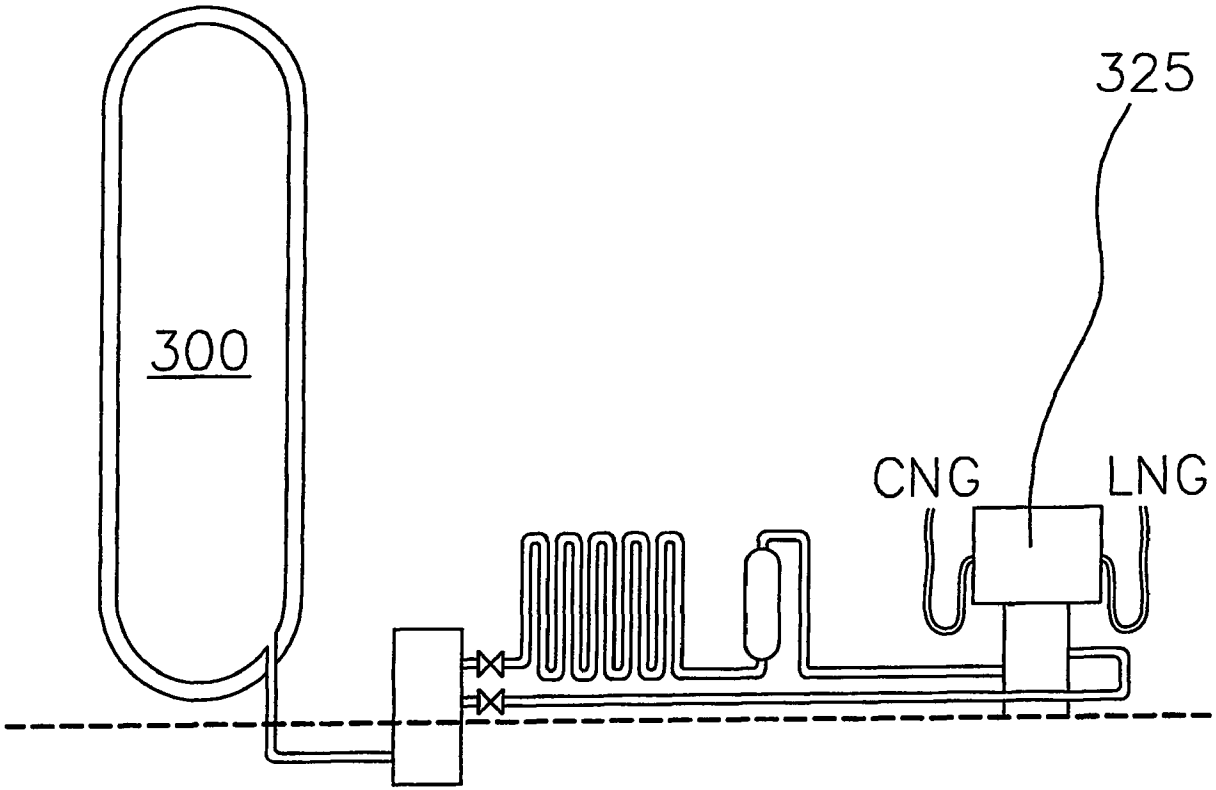
FIG. 3 is a schematic view of a combined liquefied gas and compressed gas re-fueling station comprising a single fuel pump for supplying liquefied gas and compressed gas and a combined liquefied gas and compressed gas dispenser.

FIG. 3 is another arrangement for a combined LNG and CNG re-fueling station. Components similar to those in FIG. 1 are numbered with reference numerals increased by an increment of 200, and will not be described again. The chief difference with the arrangement of FIG. 3 is that LNG storage tank 300 is located above ground. An above-ground configuration for a LNG storage tank is more typical of conventional re-fueling stations because it allows the fuel pump to be located below the tank to facilitate ensuring a positive NSH. As already discussed, while there are advantages to locating the tank underground, FIG. 3 shows that the present method and apparatus can also be adapted for use with existing above-ground LNG storage tanks.

Another difference between the other illustrated embodiments is that instead of separate LNG and CNG dispensers, the embodiment of FIG. 3 employs a single dispensing unit that combines into one apparatus the dispensing equipment for dispensing either CNG or LNG. A single dispensing unit may be preferred where there is not sufficient space for separate CNG and LNG dispensers.

FIGS. 4*a* and 5*a* show two preferred embodiments of a fuel pump suitable for the fuel pump units shown in FIGS. 1 through 3. The fuel pumps shown in FIGS. 4*a* and 5*a* are capable of pumping both liquid and vapor.

With reference now to FIG. 4*a*, fuel pump 400 is a two chamber hydraulically driven reciprocating piston fuel pump. Fuel pump 400 is preferably disposed within a sump (not shown), and fuel enters first chamber 410 through one-way inlet 405. A retraction stroke is shown in FIG. 4*b*, where piston 430 is moving in the direction of arrow 435. One-way pass-through valve 415 is closed and fuel within second chamber 420 is pushed out through fuel pump discharge 425 by advancing piston 430.

During an extension stroke (shown in FIG. 4*c*), where piston 430 is moving in the direction of arrow 436, one-way inlet 405 is closed, and advancing piston 430 pushes fuel from first chamber 410, through open one-way pass-through valve 415 and into second chamber 420. Because the displaced volume of first chamber 410 is much larger than the displaced volume of second chamber 420, fuel is discharged through fuel pump discharge 425 during the extension stroke as well as during the retraction stroke. In preferred embodiments, the displaced volume of first chamber 410 is about twice the displaced volume of second chamber 420.

Because fuel is discharged during both the retraction and extension strokes, the fuel pump operates as a "double-acting" pump.

In the embodiment of FIG. 4*a*, a hydraulic drive 440 may be employed to drive the reciprocating motion of piston 430. The hydraulic drive operates in a known manner. That is, one chamber of the hydraulic drive is supplied with high-pressure hydraulic fluid, while hydraulic fluid is removed from the chamber on the opposite side of hydraulic piston 445. At the end of a piston stroke, the hydraulic fluid is supplied to the opposite side of hydraulic piston 445 to reverse piston movement and cause reciprocating motion. In the embodiment of FIG. 4, hydraulic drive 440 comprises a single hydraulic cylinder.

With reference to FIG. 5*a*, fuel pump 500 is shown with the fuel pump inlet end disposed within a sump. Fuel pump 500 further comprises dual hydraulic drive 540. Features similar to those of the embodiment shown in FIG. 4 are identified by reference numbers increased by an increment of 100.

During a retraction stroke piston 530 moves to expand the volume of first chamber 510 and fuel from the sump is drawn into fuel pump 500 through one-way inlet 505. One-way pass through valve 515 is closed during the retraction stroke and fuel within second chamber 520 is pushed through fuel pump discharge 525 by advancing piston 530. During an extension stroke, fuel flows from first chamber 510 through one-way pass-through valve 515 and into second chamber 520. One-way inlet 505 is closed during the extension stroke. As with fuel pump 400, because of the differential volume between the first and second chambers, fuel is discharged through fuel pump discharge 525 during both the retraction and extension piston strokes.

Fuel pump 500 further comprises fuel recovery port 532. Fuel that leaks from second chamber 520 into the space above is drained therefrom and back into the sump through fuel recovery port 532.

As noted above, the desired fuel pump speed may be changed depending on whether fuel is being delivered to the CNG dispenser or the LNG dispenser. The dual hydraulic drive arrangement shown in FIG. 5 allows the selection of a smaller hydraulic cylinder when fuel is being delivered to a LNG dispenser. As shown in FIG. 5*b*, high-pressure hydraulic fluid is directed to one side of hydraulic piston 545*a* while hydraulic fluid is removed from the opposite side, with the supply of high-pressure hydraulic fluid alternating from one side to the other to cause reciprocating motion. Hydraulic piston 545*a* is smaller than hydraulic piston 545*b*, and the differently sized hydraulic cylinders are sized to match the requirements of the fuel pump for delivering LNG and CNG respectively. Compared to when CNG is required, when fuel pump 500 is driven by the reciprocating motion of hydraulic piston 545*a* in the smaller hydraulic cylinder, with the same hydraulic pump flow, fuel pump 500 can be operated at a higher speed because the displaced volume is smaller, allowing LNG to be delivered with a relatively high mass flow rate and at relatively low pressure. When fuel is being delivered to the LNG dispenser, larger hydraulic piston 545*b* is idle. Both chambers of the idle larger hydraulic cylinder may be connected to a hydraulic reservoir, or in a preferred arrangement, the hydraulic chambers on opposite sides of larger hydraulic piston 545*b* are in fluid communication with each other (as shown in FIG. 5*b*).

When fuel is being delivered to the CNG dispenser, larger hydraulic piston 545*b* is selected, (as shown in FIG. 5*c*), and smaller hydraulic cylinder and hydraulic piston 545*a* is idle. Because CNG is delivered at higher pressures (compared to LNG), larger hydraulic piston 545*b* reduces the requisite maximum pressure of the hydraulic fluid, which reduces the cost of the hydraulic pump unit.

Hydraulic fluid that leaks from the hydraulic cylinders is captured and recovered through drain pipe 550.

While not illustrated in the Figures, the exterior of the fuel pump, sump, piping, valves and dispensers that handle LNG at cryogenic temperatures are thermally insulated to prevent heat transfer into the system.

If the pump has been idle for a period of time, it may need to be cooled prior to supplying fuel to the CNG or LNG dispenser. During cool down procedures, LNG entering the fuel pump vaporizes until the fuel pump is cooled to cryogenic temperatures. During the cool down period, because of the vaporization of the LNG, the fuel pump operates with a much reduced mass flowrate and the fuel is recirculated to the LNG storage tank. A shorter cool down period may be achieved by driving fuel pump 500 during the cool down procedure with the smaller hydraulic cylinder, because this allows a faster pump speed and a higher mass flow rate.

As will be apparent to those skilled in the art in light of the foregoing disclosure, many alterations and modifications are possible in the practice of the present invention without departing from the scope thereof. Accordingly, the scope of the present invention is to be construed in accordance with the substance defined by the following claims.

What is claimed is:

1. A re-fueling station for selectively dispensing fuel in the form of liquefied gas or compressed gas, said re-fueling station comprising:

(a) a storage tank within which liquefied gas may be stored;

(b) a dispensing system comprising:

a first dispenser for dispensing compressed gas;

a second dispenser for dispensing liquefied gas;

a heat exchanger operable to transfer heat to the fuel;

a flow diverter operable to receive fuel through an inlet and selectively direct fuel through one of a first outlet or a second outlet;

conduits through which fuel may flow from said first outlet to said heat exchanger and then to said first dispenser, or from said second outlet to said second dispenser; and (c) a positive displacement fuel pump operable to draw fuel from said storage tank and discharge fuel to said inlet of said flow diverter, wherein said pump is selectively operable in:

a low speed mode when fuel flow is directed to said first dispenser to deliver compressed gas; and a high speed mode when fuel flow is directed to said second dispenser to deliver liquefied gas, whereby said fuel pump operates with a higher number of cycles per minute compared to when said fuel pump is operated in said low speed mode.

2. The re-fueling station of claim 1 wherein said pump is a reciprocating piston pump that can pump liquefied gas, vapor, or a mixture of liquefied gas and vapor.

3. The re-fueling station of claim 2 wherein said reciprocating piston fuel pump is driven by at least one hydraulic cylinder.

4. The re-fueling station of claim 3 wherein one of two hydraulic cylinders is selectable to drive said reciprocating piston fuel pump, wherein a first cylinder is operated when said low speed mode is selected, and a second cylinder, which has a smaller displacement than said first cylinder, is operated when said high speed mode is selected.

5. The re-fueling station of claim 4 wherein one hydraulic pump supplies hydraulic fluid selectively to one of said two hydraulic cylinders, whereby one hydraulic cylinder is operable while the other hydraulic cylinder is idle.

6. The re-fueling station of claim 5 wherein said hydraulic pump is a variable speed pump.

7. The re-fueling station of claim 2 wherein said reciprocating piston fuel pump is a double-acting fuel pump.

8. The re-fueling station of claim 7 wherein said reciprocating piston fuel pump comprises:

a first compression chamber associated with a fuel pump inlet;

a one-way inlet valve positioned in said fuel pump inlet for allowing fluid flow into said first compression chamber;

a second compression chamber associated with a fuel pump discharge port;

a reciprocable piston assembly comprising a shaft connected to a drive mechanism and a piston head that separates said first compression chamber from said second compression chamber; and a one-way transfer valve positioned in fluid passages communicating between said first and second compression chambers, said one-way transfer valve allowing fluid flow from said first compression chamber into said second compression chamber.

9. The re-fueling station of claim 8 wherein the displaced volume of said first compression chamber is larger than the displaced volume of said second compression chamber.

10. The re-fueling station of claim 9 wherein the displaced volume of said first compression chamber is about two times the displaced volume of said second compression chamber.

11. The re-fueling station of claim 8 wherein said one-way transfer valve is disposed within said piston assembly.

12. The re-fueling station of claim 8 wherein the shaft of said piston assembly is vertically aligned.

13. The re-fueling station of claim 8 wherein the shaft of said piston assembly is inclined with the lower end of said pump associated with said one-way inlet valve.

14. The re-fueling station of claim 13, wherein said fuel pump further comprises a fluid recovery chamber above said first and second compression chambers for collecting fuel and returning it to a sump which is in fluid communication with said fuel pump inlet.

15. The refueling station of claim 14 wherein said fuel is returned to said sump from said recovery chamber through an open drain port located near the bottom of said recovery chamber.

16. The re-fueling station of claim 8 wherein said fuel pump is operable with a negative net suction head.

17. The re-fueling station of claim 16 wherein said storage tank is buried underground.

18. The re-fueling station of claim 1 further comprising an accumulator vessel disposed between said heat exchanger and said first dispenser.

19. A method of operating a re-fueling station to selectively supply liquefied gas or compressed gas, said method comprising:

(a) drawing liquefied gas from a cryogenic storage tank to a reciprocating piston fuel pump;

(b) operating said fuel pump in a low speed mode when fuel is directed from said fuel pump to a heat exchanger for transferring heat to said liquefied gas and then a compressed gas dispenser; and (c) operating said fuel pump in a high speed mode when fuel is directed from said fuel pump to a liquefied gas dispenser, wherein in said high speed mode, said fuel pump operates with a higher number of cycles per minute than when said fuel pump is operating in said low speed mode.

20. The method of claim 19 wherein said fuel pump is operable at speeds between 5 and 30 cycles per minute.

21. The method of claim 19 wherein said fuel pump preferably operates between about five and twelve cycles per minute when said low speed mode is selected and at between about ten and twenty cycles per minute when said high speed mode is selected.

22. The method of claim 21 wherein said fuel pump operates at about six cycles per minute when said low speed mode is selected and at about eighteen cycles per minute when said high speed mode is selected.

23. The method of claim 19, further comprising capturing fuel that leaks from compression chambers within said fuel pump and returning such fuel to a sump in fluid communication with an inlet of said fuel pump.

24. The method of claim 19 wherein said fuel pump is operable with a negative net suction head.

25. The method of claim 24 wherein said cryogenic storage tank is buried underground.

26. The method of claim 19 further comprising driving said fuel pump with a first hydraulic cylinder when said low speed mode is selected and driving said fuel pump with a second hydraulic cylinder when said high-speed mode is selected.

27. The method of claim 26 wherein said first hydraulic cylinder has a larger displacement volume than that of said second hydraulic cylinder.

28. The method of claim 19 further comprising operating said fuel pump in said high speed mode during a cool down procedure for reducing the temperature of said fuel pump, and, during said cool down procedure returning vapor from said fuel pump to said cryogenic storage tank.

29. A method of operating a re-fueling station to selectively supply liquefied gas or compressed gas, said method comprising:

(a) drawing liquefied gas from a cryogenic storage tank to a reciprocating piston fuel pump;

(b) selectively driving said fuel pump with a first hydraulic cylinder when fuel is directed from said fuel pump to a heat exchanger for transferring heat to said liquefied gas, and then to a compressed gas dispenser;

(c) selectively driving said fuel pump with a second hydraulic cylinder when fuel is directed from said fuel pump to a liquefied gas dispenser, wherein said second hydraulic cylinder has a smaller displaced volume than that of said first hydraulic cylinder; and (d) supplying hydraulic fluid from a hydraulic pump system to the selected one of said first or second hydraulic cylinders.

30. The method of claim 29 wherein said hydraulic pump system comprises a single hydraulic pump.

31. The method of claim 29 further comprising selectively driving said fuel pump with said second hydraulic cylinder during a cool down procedure when said fuel pump is being cooled.

32. The method of claim 31 further comprising returning vapor from said pump to the vapor space of said cryogenic storage tank during said cool down procedure.

33. The re-fueling station of claim 12, wherein said fuel pump further comprises a fluid recovery chamber above said first and second compression chambers for collecting fuel and returning it to a sump which is in fluid communication with said fuel pump inlet.

* * * * *